United States Patent [19]

Hunt et al.

[11] 4,012,989

[45] Mar. 22, 1977

[54] INERTIAL FREE-SIGHT SYSTEM

[75] Inventors: Robert G. Hunt, Encino; Theodore B. Edwards, Santa Ana, both of Calif.

[73] Assignee: Summa Corporation, Las Vegas, Nev.

[22] Filed: Apr. 21, 1975

[21] Appl. No.: 569,926

[52] U.S. Cl. ..... 89/41 EA; 89/41 CE; 33/236

[51] Int. Cl.[2] ..... F41G 3/10

[58] Field of Search ..... 89/41 CE, 41 EA, 41 T, 89/41 E, 41 D; 74/5.34; 33/236

[56] References Cited

UNITED STATES PATENTS

| | | | |
|---|---|---|---|
| 2,388,010 | 10/1945 | Pohl | 89/41 CE X |
| 2,660,793 | 12/1953 | Holschuh et al. | 89/41 CE X |
| 3,070,886 | 1/1963 | Tassie | 89/41 EA X |
| 3,282,119 | 11/1966 | Shaw et al. | 74/5.34 |
| 3,383,987 | 5/1968 | MacMillan | 89/41 EA |
| 3,575,085 | 4/1971 | McAdam | 89/41 E X |

*Primary Examiner*—David H. Brown
*Attorney, Agent, or Firm*—Mario A. Martella

[57] ABSTRACT

An inertial sighting system for slaving the axis of a craft mounted movable member such as an armament system, camera, spotlight or the like to the axis of a hand held sight including two sets of inertial sensors in the form of a pair of gyroscopes for each set. One pair of gyroscopes, fixed to the craft and responsive to changes in craft attitude, provides pitch, azimuth, and roll information regarding craft attitude. The other pair of gyroscopes, fixed to the sighting device and responsive to changes in sighting device attitude, provides pitch and azimuth information regarding sight device attitude. The spin axes of the gyroscopes are initially aligned by a caging mechanism provided on a sight stowing bracket mounted on the craft and a cooperating caging mechanism on the sight. Alignment of the axes establishes a reference system, and when the sight is removed from the bracket, at the start of a tracking mission, the gyroscopes are uncaged to provide azimuth and elevation information to slave the axis of the movable member to the sight member.

11 Claims, 3 Drawing Figures

INERTIAL FREE-SIGHT SYSTEM

BACKGROUND OF THE INVENTION

This invention relates to a sight system, and, more particularly, to an improved sighting system for use on a craft wherein a movable member mounted on the craft is slaved to a relatively freely movable sight device so that the axis of the movable member is parallel to the axis of the sighting device.

There are instances in which it is desired to be able to position a member on a movable craft on, or relative to, a line of sight orientation with respect to some remote point. Typical such instances are pointing an aircraft mounted armament at another aircraft or at a point on the ground; pointing a photographic or television camera at such a "target"; pointing a spotlight or other member, e.g., infrared sensor, radar antenna and the like. Some such devices are on a true line of sight orientation while others may be on a ballistic line of sight, i.e., compensated for wind, drift, etc. Where the member is fixedly mounted with respect to the craft, the pilot achieves a "line of sight" to the target by maneuvering the craft in a line of sight orientation with respect to the target. In many instances, however, the craft mounted member is movable independently of the craft and under the control of a crew member not necessarily the pilot. In such a case, the slaving of the independently movable member, controlled by a crew member, on a line of sight orientation to a target, which may be a fixed or movable point, presents some unique problems especially for bulky items.

Where the craft on which the member is mounted is a highly maneuverable craft, such as a helicopter, further complications arise especially if the tracking mission is carried out in a hostile environment. For example, if a helicopter is used in a firing mission in which a high rate of fire type of weapon is used to sweep a zone of fire, the craft might take evasive action by a maneuver which is not the optimum to achieve effective results in the firing mission. In such an instance the crew member must be capable of directing the fire accurately at the intended target area, even though the pilot is engaged in evasive maneuvers. Essentially the same conditions exist in the case of a photographic tracking mission or other types of missions in a hostile environment.

As will be appreciated, the armament, for example, is mounted on the craft for movement in azimuth and elevation relative to the aircraft, essentially $x$–$y$ directions. The aircraft is movable in a pitch, azimuth and roll direction, i.e., $x$–$y$ and $z$ directions. The crew member, under these circumstances attempts to direct the orientation of the armament, camera or the like on a "line of sight" position to a point on the ground or elsewhere even though the craft is maneuvering and thus also moving the member mounted on the craft.

As will be appreciated, the provision of an efficient system, which is reliable and accurate, while being light weight and relatively simple mechanically and which will achieve a slaving of the craft mounted member to a "line of sight" position, has distinct advantages. To accomplish this objective by a free sight system, i.e., one which is hand held and small while being easy to move, and which is not connected to some other unit by mechanical linkages also provided unique advantages.

DESCRIPTION OF THE PRIOR ART

Sighting systems are known in which the sight is connected to a control unit by a plurality of linkages, swivels, and levers in which potentiometers or similar devices are used to determine the relative position of the sight. The electrical output of the potentiometer is then used to provide information to "slave" the gun to the sight. The objection with this type of system is the complexity, the weight and obstructive nature of the mechanical linkage needed to measure the sight movement so that reliable information may be provided from the potentiometer. An analogous type of system is described in U.S. Pat. No. 2,388,010 of Oct. 30, 1945, and U.S. Pat. No. 2,569,571 of Oct. 2, 1951.

Gyroscopes have been used on predicting-computing gun sights on aircraft, to compute lead and the like for armaments which are not movable with respect to the craft, see U.S. Pat. No. 2,963,788 of Dec. 13, 1960.

Gyroscopes have also been used in stabilizing systems, see U.S. Pat. No. 2,989,672 of June 20, 1961; auto navigational systems, see U.S. Pat. No. 3,282,118 of Nov. 1, 1966; to stabilize the line of sight of a sighting system, see U.S. Pat. No. 3,401,599 of Sept. 17, 1968, U.S. Pat. No. 3,415,157 of Dec. 10, 1968, U.S. Pat. No. 3,552,216 of Jan. 5, 1971; to slave a missile navigational system to a ship system, see U.S. Pat. No. 3,470,429 of Sept. 30, 1969; and for generating error signals corresponding to vehicle movement, see U.S. Pat. No. 3,640,178 of Feb. 8, 1972.

U.S. Pat. No. 3,282,119 of Nov. 1, 1966, describes a gyroscope system for slaving a missile mounted platform of an aircraft carried missile to a master platform on the aircraft in which resolver chains are used.

While the above described systems are operative for their intended use, none of them relate to the problem of slaving the axis of a movable member, e.g., a gun, mounted on a movable craft to the axis of a movable sighting system.

SUMMARY OF THE PRESENT INVENTION

The present invention relates to an inertial sight system for slaving the axis of a craft mounted member, e.g., armament, camera, and the like to the axis of a light weight hand held sighting device. Basically the system includes two sets of inertial sensors, for example, two pairs of gyroscopes, one pair mounted on the movable craft and one pair mounted on the independently movable sighting device. The gyroscopes mounted on the craft provide information regarding the azimuth, pitch and roll orientation of the craft, while the gyroscopes on the sighting device provide information regarding the azimuth and pitch orientation of the sight. From these data, control information can be generated in terms of the azimuth and elevation orientation needed to slave the axis of the movable member on the craft to the line of sight axis of the sight on a continuing basis, independent of the change in craft orientation. Thus, as long as the sight is maintained on a line of sight to a target, the movable member is likewise maintained on the target even though the craft changes orientation.

Conversely, if the craft is on fixed bearing, the crew member may change from one target to the next simply by moving the hand held sight, the data generated providing the control signals to keep the axis of the movable member slaved to the axis of the sight.

In one form of the invention, the sighting device is stowed in a mounting bracket fixed to the craft when not in use. The sight itself carries two gyroscopes to provide sight orientation information while the bracket supports the other two gyroscopes, providing information regarding craft orientation. The respective spin axes of the gyroscopes in each set are aligned as the sight is stowed in the bracket which operates to cage the gyroscopes. The uncaging of the gyroscopes with the spin axes in alignment operates to establish a single reference system in space. Upon removal of the sight from the bracket at the start of a tracking mission, the gyroscopes are uncaged and begin to generate the information needed to provide azimuth and elevation control data.

Data regarding craft orientation and sight orientation are fed to a coordinate converter which provides the azimuth and elevation information to position the movable member in parallel relation to the "line of sight."

The advantages of the above inertial sighting system include a lightweight sighting device which is hand held and which is not complicated by the presence of attached levers, linkages and the like. The use of an inertial sensor system cooperating with data processing package such as a coordinate converter provides simplicity and reliability, especially by simplifying the size and mechanical complexity of the gear in the crew man area. Movement of the craft relative to the target does not affect the "line of sight" to the target since the converter continuously provides command signals in terms of azimuth and elevation to slave the axis of the movable member to the sight axis.

It will be apparent that other advantages and modes will be readily apparent to and understood by those skilled in the art after they have read the detailed description and referred to the accompanying drawings which illustrate what is presently considered the best mode contemplated for utilizing the novel and improved structure set forth in the appended claims.

DETAILED DESCRIPTION

Figure 1:
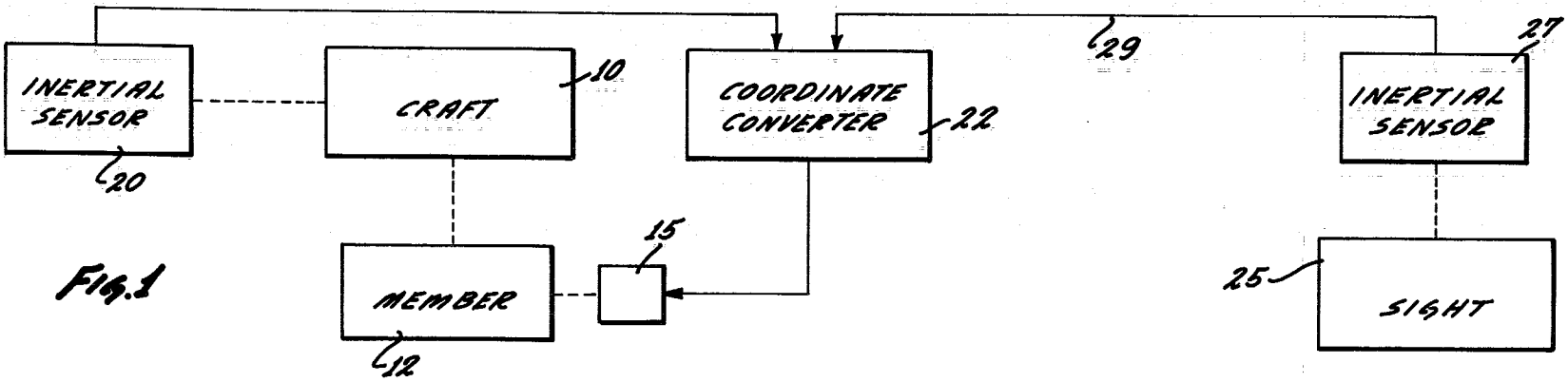
FIG. 1 is a block diagram showing the relationship of the various components of the present invention.

Referring to FIG. 1 which illustrates the general principles of the present invention, the craft 10 which may be a boat, helicopter, or airplane, for example has mechanically mounted on the craft 10, as indicated by the dotted line, a movable member 12, which may be armament such as the weapon described in Ser. No. 418,356, filed Nov. 23, 1973, and assigned to the same assignee. Where a weapon is a movable member, the "line of sight" may be a true line of sight with ballistic corrections being made by computer to bring the line of fire to the point being sighted. Other modes include positioning the sight in accordance with the needed ballistic corrections, i.e., above or below, right or left of the actual target so that fire is directed to hit the target. With other types of movable members, cameras, lights, radar, etc., a true line of sight is established since ballistic corrections for wind, trajectory, etc., are not needed. The term line of sight is thus used in the context of sight orientation needed to move the movable member in proper orientation with respect to a target. Member 12 is moved in azimuth and elevation relative to the craft 10 by control motors 15 mechanically mounted to cause movement in response to command signals. Control motors 15 are of a type well known to those skilled in the art, e.g., servo systems which are well known.

Cooperating with the craft 10 and mounted to respond to changes in craft attitude is an inertial sensor in the form of a pair of gyroscopes 20, the dotted line indicating, again, a mechanical connection to the craft. These gyroscopes 20 provide information regarding pitch, azimuth and roll of the craft 10, while information in the form of electrical signals is fed to a coordinate converter 22 and forms one of the inputs thereto.

To control the azimuth and elevation position of member 12 in accordance with this invention there is provided a hand held sighting device 25 which carries another inertial sensor system in the form of two gyroscopes 27 mechanically mounted on the sighting device as indicated by the dotted line. This pair of gyroscopes feeds data to the coordinate converter 22 indicating the orientation of the sight. Thus, the only connection to the hand held sighting device is an electrical cable 29, and accordingly, there is considerable freedom of movement of the sighting device. Information from the hand held sight may be by wireless link in which event the cable may be omitted.

Figure 2:
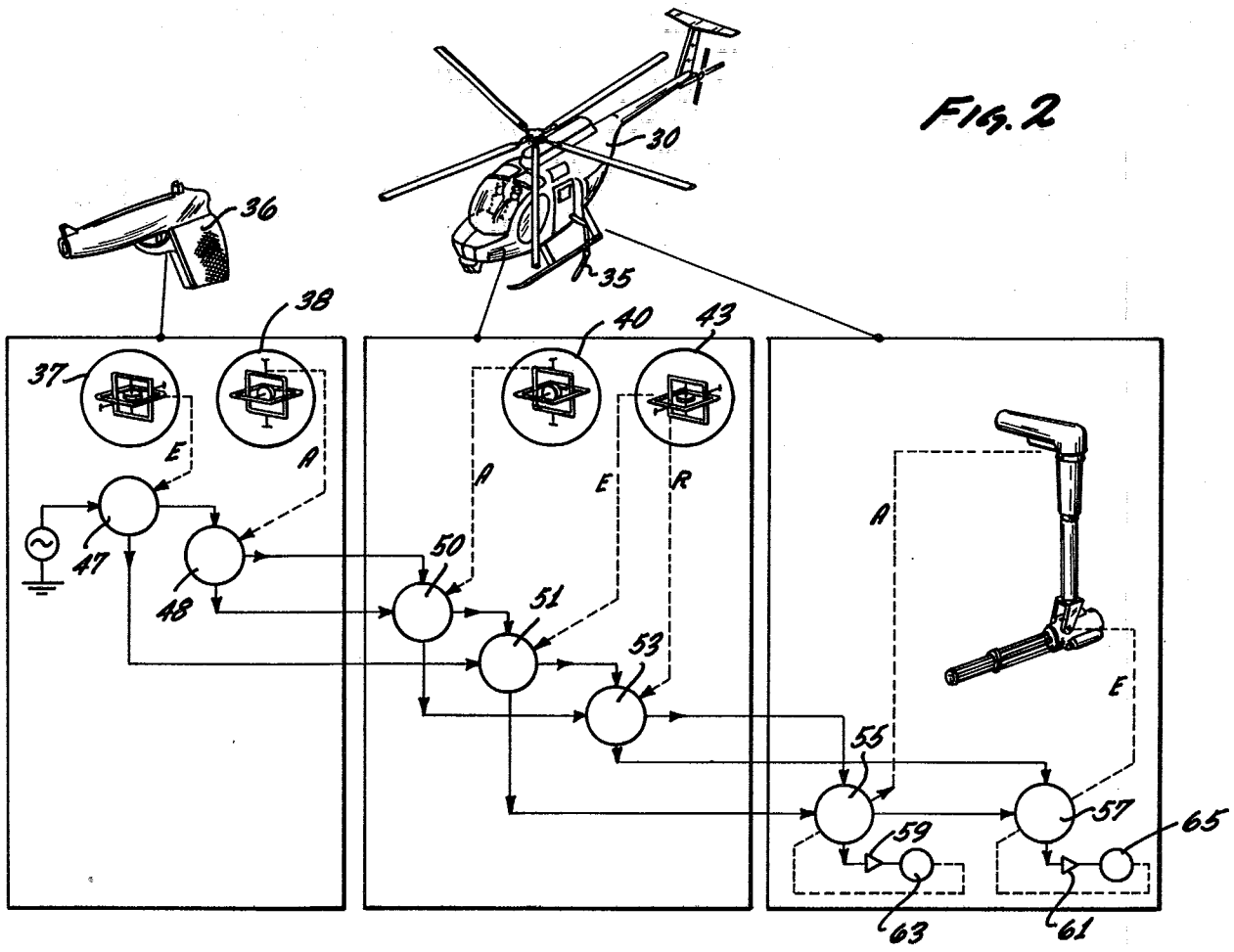
FIG. 2 is a schematic showing of an illustrative embodiment of a helicopter mounted armament system in accordance with the present invention.

Referring to FIG. 2, the craft 30 in the form of a helicopter is shown with an armament system in the form of armament such as a gun 35 mounted thereto. The gun 35 is movable in an azimuth and elevation direction relative to the aircraft. The sighting device is in the form of a pistol-shaped sighting device 36 equipped with iron sights, as shown. Other sighting devices may, however, be used, such as Newton rings or a collimated optical system.

Cooperating with the sight 36 are a pair of gyroscopes 37 and 38. Gyroscope 37 provides pitch information regarding the orientation of the sight 36 while gyroscope 38 provides information regarding azimuth orientation of the sight.

The second inertial sensor system is in the form of a pair of gyroscopes 40 and 43, the pair being mounted on the aircraft 30, preferably as described below. Gyroscopes 40 and 43 provide azimuth, and pitch and roll information relative to aircraft attitude. In effect, the gyroscopes 36, 38, 40, and 43 establish a spatially fixed reference system and then independently monitor maneuvers of the craft and orientation of the sight to provide control information used to slave the axis of the gun to the line of sight axis of the sight. As shown, all gyroscopes have complete freedom about their outer gimbal axes and $\pm 85°$ about their inner gimbal axes. This is desirable from the standpoint of tumbling and restoration of alignment.

Cooperating with the gyroscopes is a coordinate converter in the form of a resolver chain including resolvers 47, 48, 50, 51, 53, 55, and 57. Resolver chains are well known in the art and are used frequently to compute navigational problems. The resolver itself is a computing transformer having two sets of integral windings, i.e., two primary and two secondary. The windings have their electrical axis at right angles to each other, the secondaries being rotated relative to the primaries. It is possible, as is known in the art to use the stator windings as primaries.

In the system shown in FIG. 2 resolver 47 is mounted on the sight and mechanically coupled to the gimbal system of gyroscope 37 to provide voltage signals representing the pitch orientation of the sight relative to an established reference system. Likewise, resolver 48 is mounted on the sight and mechanically coupled to the gimbal system of gyroscope 38 to provide voltage signals representing the azimuth orientation of the sight relative to the established reference system. In similar fashion, resolver 50 is mechanically coupled to gyroscope 40 providing azimuth orientation of the aircraft 30 relative to the reference system, while resolvers 51 and 53 are mechanically coupled to the gimbal system of gyroscope 43 to provide pitch and roll orientation information of the craft relative to the reference system. Resolvers 55 and 57 are attached to the gimbal or pinion system of the gun 35 (movable member) and cooperate with the other resolver to compute the azimuth and elevation motion needed to bring the gun axis into proper relation with the sight axis. As shown, the outputs of resolvers 55 and 57 are fed through amplifiers 59 and 61, respectively and to control motors 63 and 65 respectively, to slave the gun to the sight. Thus, the resolver chain, well known in the art, constitutes a coordinate converter unit that continuously supplies control signals to control azimuth and elevation of the gun axis to maintain it parallel to the sight axis during a tracking mission.

Figure 3:
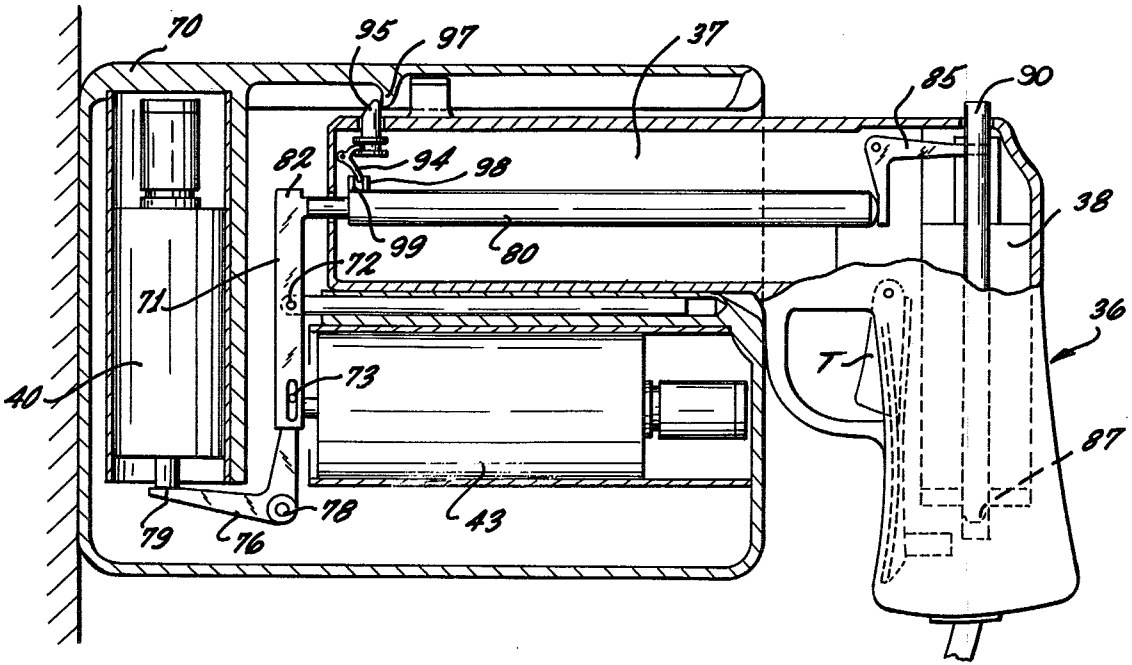
FIG. 3 is a view partly in section and partly in elevation of the hand held sight and stowing bracket in accordance with the present invention.

Referring to FIG. 3, the hand held sight 36, when not in use is mounted on a stowing bracket 70 fixed to the craft. The stowing bracket has mounted therein gyroscopes 40 and 45 and the cooperating resolvers. Mounted within the hand held sight are gyroscopes 37 and 38 and the cooperating resolvers. Combined gyroscopes and resolver units are well known per se and thus will not be described further. As shown, the sight includes a trigger T to control operation of the gun, camera or light and the like.

The stowing bracket includes a linkage for caging the gyroscopes in the bracket while the sight likewise includes a linkage for caging the sight gyroscopes. Supported within the stowing bracket 70 is a lever 71 which pivots at 72, one end 73 of the lever cooperating with the L-shaped lever 76 which pivots at 78. The end 79 of lever 76 engages a caging mechanism for gyroscope 40 when the lever 76 is actuated by lever 71. The end 73 of lever 71 also actuates a caging mechanism for gyroscope 43.

The sight 36 includes a plunger 80 which contacts a free end 82 of lever 71 as the sight is inserted into the bracket, the plunger 80 moving to the right, as seen in FIG. 3 to pivot L-shaped lever 85, the latter actuating a plunger 87. Plunger 80, lever 85 and plunger 87. Plunger 80, lever 85 and plunger 87 operate to actuate the caging mechanism for gyroscopes 36 and 37 at the same time that lever 71 of the bracket operates through the linkages to cage gyroscopes 40 and 43 when the sight is pushed into the bracket. All plungers and levers are spring loaded to the uncage position.

The sight is also provided with an unlatch mechanism in the form of a spring loaded button 90 cooperating with L-shaped lever 85 and lever 94. Lever 94 operates to retract a latch member 95 biased in the latch position to engage a latch lug 97 provided in the housing. As shown, the end of plunger includes actuating steps 98, 99 which encage one arm of lever 94. The other arm of lever 94 bears against the latch, the latter configured to hold the arm, as shown. As the sight 36 is stowed in the bracket 70, latch 95 rides over the lug and secures the sight in the bracket and the gyroscopes are caged, as described. To withdraw the sight, button 90 is depressed to retract the latch 95 below the lug and permitting the sight to the withdrawn and uncaging the gyroscopes. If desired, an enable switch may be included, or combined with the unlatch mechanism to activate the electrical data flow of the system, or to actuate an arming system, or both, for example.

In caging the gyroscopes, the spin axes of 37 and 43 are aligned while the spin axes of 38 and 40 are aligned thus forming a single reference system which can be arbitrary since the reference system only functions to establish the relative attitude of the sight axis and the gun axis. When the sight is removed from the bracket, the reference system orientation will be identical to craft orientation at that moment. Whenever the sight is uncaged a new reference system is established. Once uncaged, information is continuously fed through the resolver chain to provide gun orientation command signals. Caging the gyroscopes also operates to compensate for gyroscope drift which is nominally less than 0.25 degrees per minute.

While the sensors are described, for purposes of explanation with respect to gyroscopes, other sensors may be used, as well as read-out devices such as potentiometers. Other types of coordinate converters may be used as are well known in the art.

It will be apparent to those skilled in the art that the present invention offers the advantage of a simple, reliable system for slaving the axis of a movable member mounted on a craft to the line of sight axis of a sighting device. To be able to control the axis of the movable member mounted on a highly maneuverable craft in such a relatively simple manner has distinct advantages since the craft need not be aligned in a line of sight orientation with respect to the target.

It will be apparent to those skilled in the art from the foregoing description that various changes, substitutions and modifications may be made without departing from the spirit and scope of this invention as set forth in the appended claims.

We claim:

1. An inertial hand-held sight system for slaving the axis of an aircraft mounted movable member to the axis of a hand-held sight comprising:

hand-held sight means adapted to be positioned on a line of sight to a target, a first and second set of inertial sensors one of which is mounted on said hand-held sight means and the other of which is mountable on an aircraft, said one set of inertial sensors providing information regarding the pitch and azimuth orientation of the sight means, the other set of inertial sensors providing information regarding the pitch, azimuth and roll orientation of the aircraft on which said sensors are mounted, and means cooperating with each set of inertial sensors to receive the information regarding the orientation of the sight means and the orientation of the aircraft and to provide control information of the pitch and azimuth orientation needed to maintain the axis of the movable member in parallel relation to the axis of the hand-held sight means.

2. An inertail hand-held sight system as set forth in claim 1 further including stowing means for said hand-held sight means, said stowing means being mountable on an aircraft, and said other set of inertial sensors beng mounted on said stowing means.

3. An inertial hand held right system as set forth in claim 2 wherein said inertial sensors are gyroscopes, and said stowing means and said hand held sight means including cooperating means operative to cage said gyroscopes such that the spin axes of those gyroscopes providing azimuth and pitch information, respectively, are in alignment.

4. An inertial hand held sight system as set forth in claim 1 wherein said movable member is armament means.

5. An inertial hand held sight system as set forth in claim 3 wherein caging of said gyroscopes is operative to establish a reference orientation and wherein removal of said sight means from said stowing means is operative to uncage said gyroscopes.

6. An inertial hand-held sight system as set forth in claim 3 further including latching means to secure said sight in said stowing means.

7. An inertial hand-held sight system as set forth in claim 1 wherein coordinate converter means cooperate with said inertial sensors to receive orientation information regarding aircraft orientation information regarding aircraft orientation and information regarding the orientation of the hand held sight to provide said control information.

8. An inertial hand-held sight system as set forth in claim 5 wherein said means cooperating with each set of sensors continuously receives information upon uncaging of said gyroscopes.

9. An inertial hand-held sight system for slaving the axis of craft mounted armament means in parallel relation to a sighting device comprising:

a free independently movable sighting device adapted to be positioned on a line of sight to a target, first and second inertial sensor means one of which provides information regarding the orientation of the craft, the other of which provides information regarding orientation of the sighting device, and means to compare the information regarding craft orientation with the information regarding sighting device orientation to provide control information for maintaining the axis of said armament aligned with the axis of said sighting device independently of any changing orientation of the craft.

10. A system as set forth in claim 9 wherein:

said one sensor means including a first and second gyroscopes fixedly mounted on said craft and providing pitch, azimuth and roll information regarding the orientation of the craft, the other sensor means including third and fourth gyroscopes coopertively associated with said sighting device to provide pitch and azimuth information regarding the orientation of said sighting device, and said means to compare the information being coordinate converter means responsive to the pitch, azimuth and roll of the craft and the pitch and azimuth of the sighting device to provide elevation and azimuth information to maintain the axis of the armament means in parallel relation to the line of sight orientation of said sighting device.

11. A system as set forth in claim 10 further including, means to cage said gyroscopes such that the spin axes thereof are aligned to establish an inertial reference system for each tracking mission of said sighting device, and means to uncage said gyroscopes at the start of a tracking mission whereby the respective gyroscopes provide attitude angle information of the craft orientation and the sighting device orientation to be converted to azimuth and elevation information for continuously slaving the axis of the armament to the axis of the sighting device during a tracking mission.

* * * * *